US007104758B2

(12) United States Patent
Brock et al.

(10) Patent No.: US 7,104,758 B2
(45) Date of Patent: Sep. 12, 2006

(54) ROTOR OF A STEAM OR GAS TURBINE

(75) Inventors: Hans-Egon Brock, Oberhausen (DE); Günter Neumann, Bochum (DE); Hans Jeske, Reppenstedt (DE)

(73) Assignee: MAN TURBO AG, (DE)

( * ) Notice: Subject to any disclaimer, the term of this patent is extended or adjusted under 35 U.S.C. 154(b) by 43 days.

(21) Appl. No.: 10/926,439

(22) Filed: Aug. 25, 2004

(65) Prior Publication Data

US 2005/0047917 A1 Mar. 3, 2005

(30) Foreign Application Priority Data

Sep. 2, 2003 (DE) ..... 103 40 773

(51) Int. Cl.
*F01D 5/26* (2006.01)

(52) U.S. Cl. ..... 416/190; 416/191; 416/217; 416/500

(58) Field of Classification Search ..... 416/189, 416/190, 191, 192, 195, 196 R, 215, 216, 416/217, 500

See application file for complete search history.

(56) References Cited

U.S. PATENT DOCUMENTS

| | | | | |
|---|---|---|---|---|
| 2,310,412 | A | | 2/1943 | Fiander |
| 2,430,140 | A | | 11/1947 | Phelan et al. |
| 2,942,843 | A | | 6/1960 | Sampson |
| 3,752,599 | A | | 8/1973 | Pace |
| 3,918,842 | A | * | 11/1975 | Longley et al. ..... 416/219 R |
| 4,784,571 | A | | 11/1988 | Ferleger et al. |
| 2001/0038793 | A1 | | 11/2001 | Brandi et al. |

FOREIGN PATENT DOCUMENTS

| | | | |
|---|---|---|---|
| CH | 418360 | | 8/1966 |
| CH | 418 360 | | 2/1967 |
| DE | 1005084 | | 3/1957 |
| GB | 532372 | | 1/1941 |
| JP | 55152673 | | 10/1980 |
| JP | 570760208 | | 8/1982 |
| JP | 58176402 | | 1/1984 |
| JP | 05086803 | | 8/1993 |
| JP | 06221102 A | * | 8/1994 |
| JP | 2000/204901 | | 11/2000 |

* cited by examiner

*Primary Examiner*—Richard A. Edgar
(74) *Attorney, Agent, or Firm*—McGlew & Tuttle, PC

(57) ABSTRACT

A rotor of a steam or gas turbine is equipped with rotor blades, which are held in the rotor (6) in a plurality of radial rows and comprise a blade foot 1 installed in the rotor (6), a blade leaf (2) and a cover plate (3). An open pocket (5) is prepared in the sloping surfaces of the cover plates (3) of a row of rotor blades, which the sloping surfaces are located opposite each other. The pockets (5) of two adjacent cover plates (3) form together an essentially closed cavity, which expands in the radial direction of the rotor (6). A pin, whose largest cross section is smaller than the largest cross section of the cavity but larger than the smallest cross section of the cavity, is placed freely movably into each cavity.

16 Claims, 7 Drawing Sheets

ROTOR OF A STEAM OR GAS TURBINE

CROSS REFERENCE TO RELATED APPLICATIONS

This application claims the benefit of priority under 35 U.S.C. § 119 of DE 103 40 773.1 filed Sep. 2, 2003, the entire contents of which are incorporated herein by reference.

FIELD OF THE INVENTION

The present invention pertains to a rotor of a steam or gas turbine with rotor blades, which are held in the rotor in a plurality of radial rows and each comprise a blade foot installed in the rotor, a blade leaf and a cover plate.

BACKGROUND OF THE INVENTION

The following description pertains to the application of the present invention in a steam turbine. The statements made analogously also apply to gas turbines.

Steam turbines are used mainly as powerplant turbines for generating electricity and as industrial turbines for driving generators, pumps, fans and compressors. The steam turbine is a heat engine with rotating rotors, in which the enthalpy gradient of the continuously flowing steam is converted into mechanical energy in one or more stages.

The blading of the rotating rotor of the turbine shall convert the enthalpy of the steam into kinetic energy possibly in a lossless manner and transmit the forces occurring in the process to the shaft and the housing of the turbine. The steam now flows from a space having a higher pressure through a nozzle into a space being under a lower pressure. The greater the pressure difference, the greater is the velocity of the steam attained. After the discharge from the nozzle, the steam reaches the curved profile of the first rotor blade stage, the so-called regulating stage. Subsequently, the deflection takes place in the stationary guide vane stage for a subsequent flow through the next rotor blade stage again. Depending on the design and the size of the turbine, the process is repeated several times. The profile length of the rotor blades and guide vanes increases in the direction of flow. As a result, the space flown through increases, as a consequence of which the pressure and the temperature of the steam decrease. Large turbines are divided into a high-pressure part, a medium-pressure part and a low-pressure part.

The profile of each blade is a compromise between fluidic, strength-related, vibration-related and economic requirements. The blade profiles are available with mostly geometrically graduated chord lengths. The blades in a turbine are subject to many different loads and stresses. To guarantee a long operating time and to avoid damage, the blades must be designed and dimensioned correspondingly for safety. A rotor blade must have, for example, a sufficient strength in order to absorb the load caused by the centrifugal forces occurring as well as by the bending due to the torque to be transmitted. Additional load factors are the temperature at the inlet, which reaches up to 530° C., and the erosion corrosion occurring on the profile inlet sides due to the moisture content of the steam in the low-pressure range.

In addition to the stress caused by centrifugal forces, temperature and erosion corrosion, the rotor blades are subject to stress due to vibration. Vibration is induced in the rotor blades by the flowing steam in conjunction with other acting forces. The stress due to vibration leads, in the long term, to a change in the microstructure of the blade material. Incipient cracks of submicroscopic size are formed at first in the near-surface area, and they merge over time. After the damaging phase of the merging of the cracks, an incipient technical crack is finally formed, which extends at right angles to the highest principal direct stress and induces a considerable excessive increase in stress at the tips of the cracks. If the crack is not recognized or the blade is not replaced, fatigue fracture will occur at the end of the process. Damage due to stress due to vibration is among the most frequent causes of damage in material engineering, partly because the actual stress groups are unknown and partly because no complete theory can be set up as a consequence of the large number of material engineering influential factors.

Among other things, the following solutions are used to damp the vibrations of the rotor blades of steam turbines.

A wire extending circularly in holes in the profile area damps the vibrations in larger end-stage blades in the low-pressure range of the turbine.

In rotor blades, which are loaded by a low circumferential velocity only, a shrouding is riveted in sections by means of rivet pins to the profile end of the blades installed in the turbine rotor. This design was frequently used in older turbines. The strength of the riveted connection is not sufficient in modern turbines with high circumferential velocities. The riveted design is ruled out here.

Cover plate rotor blades, which combine good strength properties with high efficiencies, are now used almost exclusively in the high-pressure and medium-pressure areas of turbines. The blade and the piece of shrouding (cover plate) belonging to it form one unit in this design. The cover plates of the individual rotor blades form a ring after their installation in the turbine rotor. The vibration is damped in them at the contact surfaces between the individual blades. The drawback of the low strength of the riveted connection is thus avoided.

However, the design of the rotor blades provided with cover plates has the following weak points. It is not always possible in practice to install the rotor blades without clearance in relation to one another because of the different tolerances of each rotor blade in a stage with, e.g., 100 rotor blades. Another reason is the strong centrifugal forces, which act on every individual rotor blade in the operating state of the turbine. The centrifugal forces cause the blades to be somewhat offset to the outside. Since each rotor blade forms a wedge with its foot and cover plate surfaces, a gap is formed at the cover plate surfaces between the individual rotor blades due to the described outward settling of the blades. The vibrations are no longer damped as described because of the gap formation.

Several prior-art solutions are available for avoiding the described drawback caused by the gap formation between the cover plates of the rotor blades.

A plane groove each, in which a circular wire is introduced, is turned in the two plane faces of the cover plates after the installation of the rotor blades in the turbine rotor. The blades are connected with one another by the wire, and the vibrations are damped. The drawback of this solution is that a sufficient cover plate height must be available to install the wire. Heavy weight of the cover plates leads to a reduction of the possible speed of rotation of the turbine because of the events that are to be taken into account in the calculation of the strength.

In a second design, the cover plates are manufactured with a slight angular twisting in relation to the blade foot. After their installation in the turbine rotor, the rotor blades are under a certain torsional stress, which compensates the gap formation and guarantees damping of the vibrations as a result. However, this solution is expensive because of the manufacturing technology and difficult to design.

Furthermore, the rotor blades must have a certain minimum length for their use in order to make it possible to generate a torsional stress in the first place. In the longer term, the stress decreases due to wear on the contact surfaces and material fatigue. Vibration damping is no longer present thereafter.

SUMMARY OF THE INVENTION

The basic object of the present invention is to provide the rotor blades of the turbine rotor of this type with a reliably acting damping, which can be manufactured in a simple manner and at a low cost. The present invention shall also be able to be applied to rotor blades that are installed in high-speed turbines as well as to rotor blades that have a small overall length and a small cover plate height.

This object is accomplished according to the present invention with a rotor of a steam or gas turbine with rotor blades, which are held in the rotor in a plurality of radial rows. The blades each comprise a blade foot installed in the rotor, a blade leaf and a cover plate. An open pocket is formed in the sloping surfaces of the cover plates of one row of the rotor blades. The sloping surfaces are located opposite each other. The pockets of two adjacent cover plates together form an essentially closed cavity. The cavity expands in the radial direction of the rotor. A pin having a largest cross section that is smaller than the largest cross section of the cavity and larger than the smallest cross section of the cavity is placed freely movably in each cavity.

The wedge-shaped pockets are each milled according to the present invention in the two sloping surfaces of the cover plates. During the installation of the moving plates, two pockets each at the contact surfaces of the cover plates form the cavity, which is closed essentially on all sides and has the shape of a drop or a pear. The pin, whose shape and size are adapted to the cavity, is inserted into each cavity during the installation of the rotor blade on the rotor. The pin may have a cylindrical shape or, similarly to the pocket, also a profiled shape. It is important that the pin easily fit the cavity with its cross section and length. Consequently, it shall have a clearance on all sides in order for the planes of division of the rotor blades to come into contact during their installation.

In the operating state of the turbine, the loose pins are pressed outwardly in the cavity by the centrifugal force. They thus generate a connection between the rotor blades independently from the size of a gap that may possibly be present between the cover plate surfaces. The vibrations are damped within the rotor blade stage by the contact surfaces between the rotor blade and the pin. The wedge angle in the cavity must be located outside the self-locking for the pin. The two front sides in the cavity and the front sides at the pin must be coordinated with one another such that the pin does not become jammed.

The material pairing between the rotor blade and the pin is selected for low wear.

The present invention has the following advantages. With a uniform pressing force, each pin fits individually the gap between the rotor blades, which is generated by the thermal expansion and the centrifugal force. The stage can readily relax in the stopped state. The mode of action of the present invention is reliably preserved over the entire operating time of the installed stage of rotor blades. The manufacture is simple and can be carried out at low cost.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
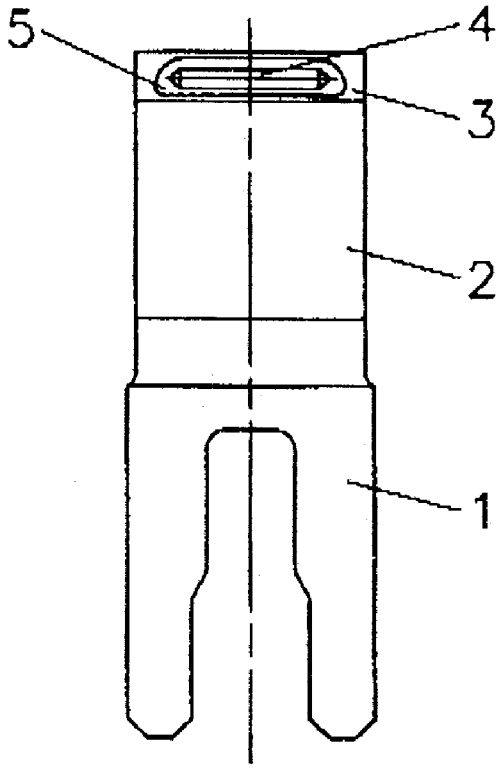
FIG. 1 is a front view of a rotor blade.
Figure 2:
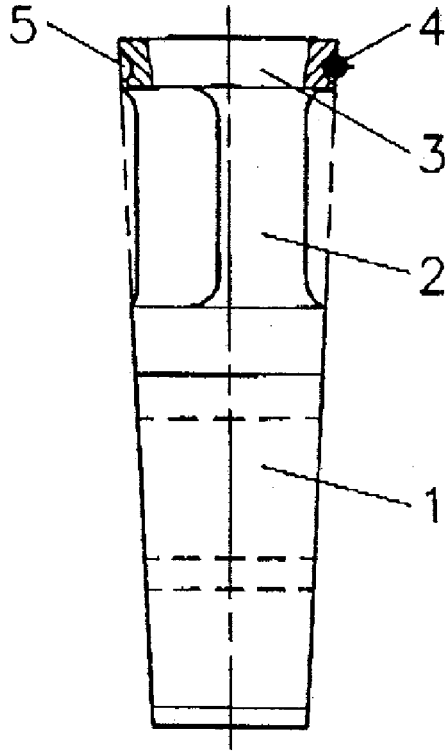
FIG. 2 is a side view of FIG. 1.
Figure 3:
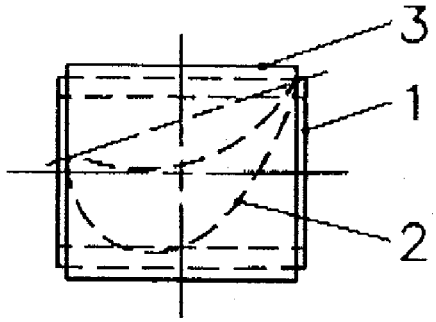
FIG. 3 is a top view of FIG. 1.

The rotor blade, which is preferably used in the high-pressure and medium-pressure parts of a turbine, comprises a blade foot 1, which has a conical shape and is designed as a plug-in foot in the case being shown, as well as a streamlined blade leaf 2 and a cover plate 3, which is arranged at the profile end of the blade leaf 2 and lies with its two sloped planes of division on the same radial plane as the two sloped foot surfaces. The cross section of the blade foot 1 and the cover plate 3 is shown as a rectangle in FIG. 3. However, the present invention is equally applicable to rotor blades with a rhomboid cross section.

Figure 4:
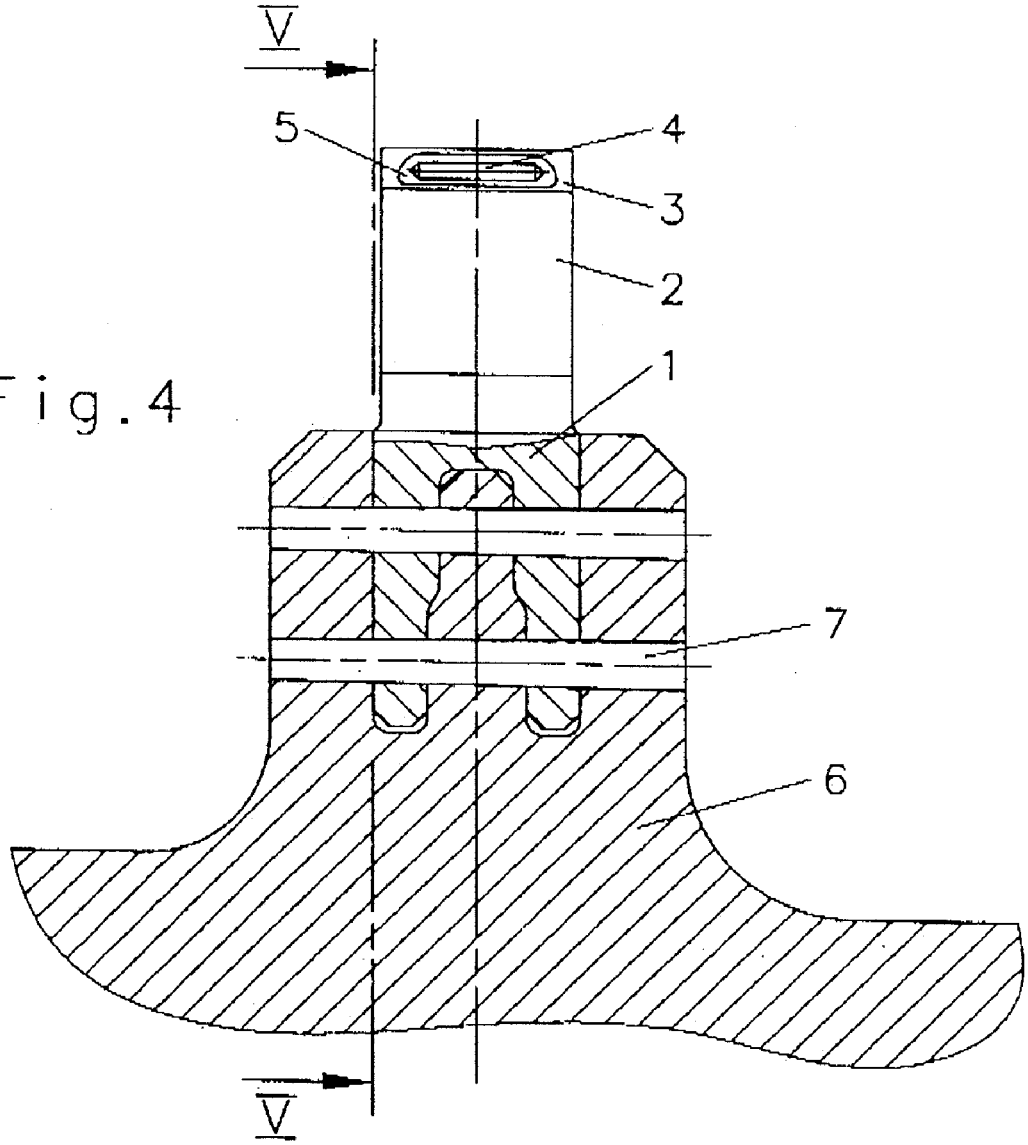
FIG. 4 is an axial section IV—IV according to FIG. 5 through a rotor blade installed in a rotor.
Figure 5:
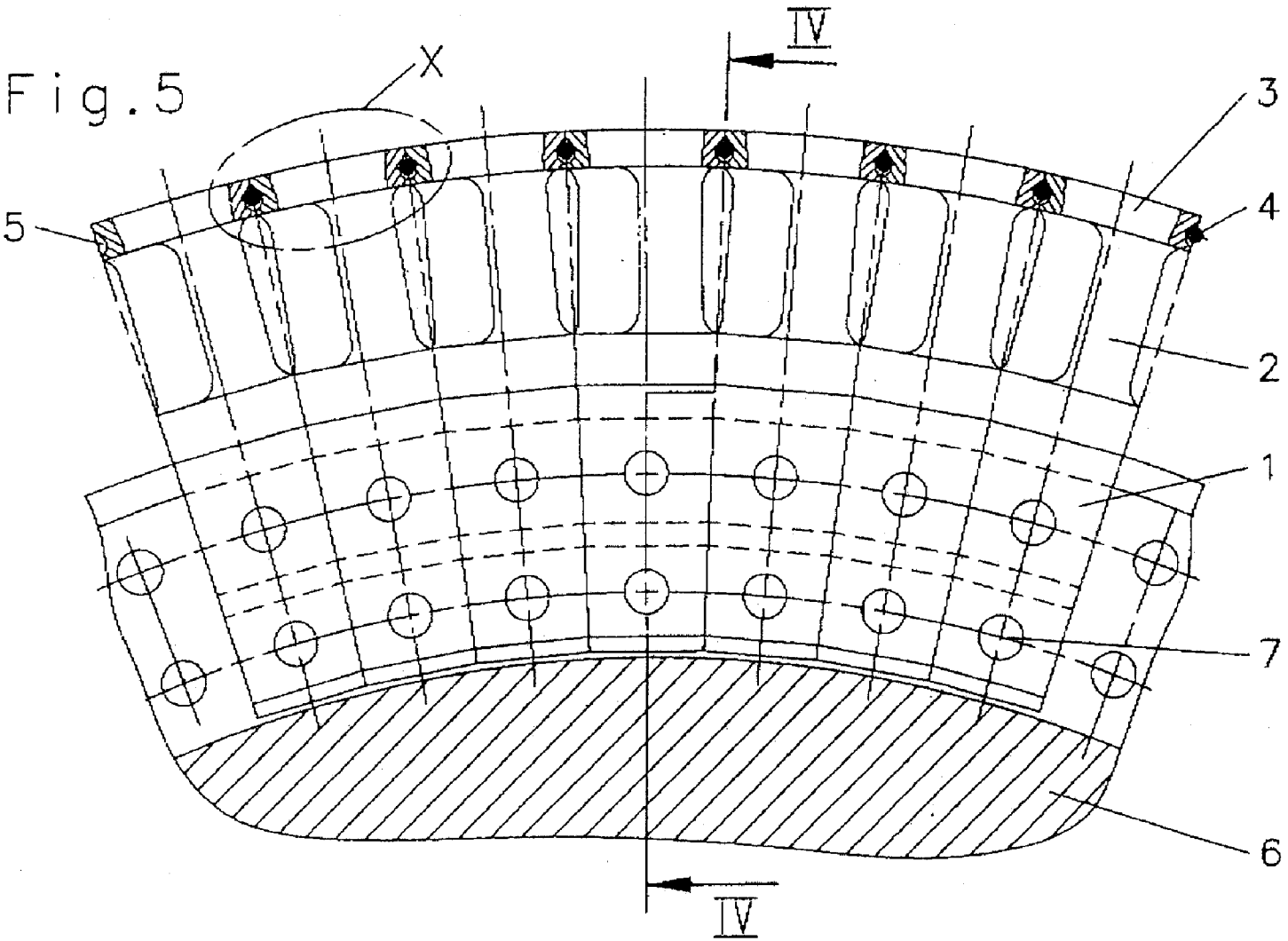
FIG. 5 is a radial section V—V according to FIG. 4.
Figure 6:
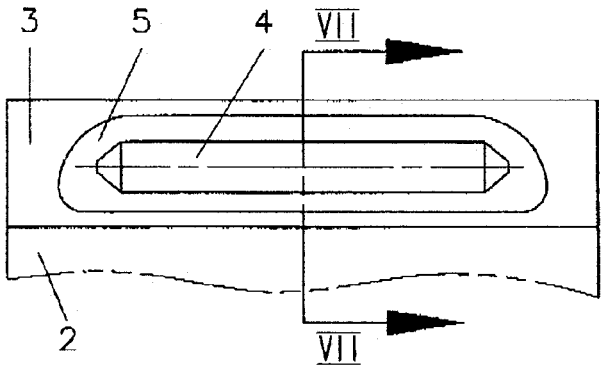
FIG. 6 is a enlarged front view of the pocket in the cover plate with the inserted pin.
Figure 9:
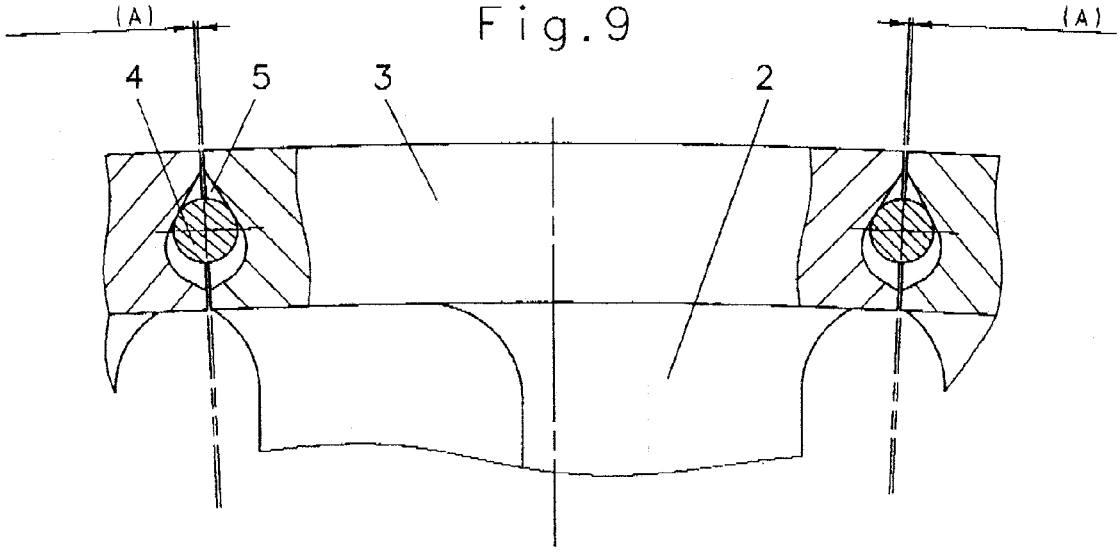
FIG. 9 is detail X according to FIG. 5 on a larger scale in the operating state of the turbine.

The blade feet 1 are inserted radially into an adapted circumferential groove of the rotor 6 of the turbine and are held by two conical pins 7 each in the rotor 6 in the case shown in FIG. 4. The shape of the blade feet 1 may also deviate from the view shown and may be, e.g., a simple or double hammer head. The blade feet 1 and the cover plates 3 of the rotor blades arranged in a row are located at closely spaced locations from one another in the installed state shown in FIG. 5, and there is a gap A of a small width (FIG. 9).

Figure 7:
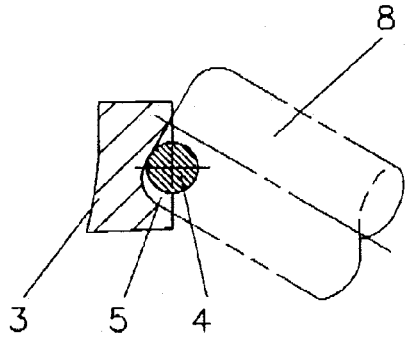
FIG. 7 is a section VII—VII through FIG. 6 with a shank-type cutter indicated.

An open pocket 5, which extends over the middle area at the level of the cover pate, is prepared by milling by means of a shank-type cutter 8 in the sloping surfaces of the cover plates 3 of two adjacent rotor blades, which said sloping surfaces are located opposite each other. Depending on the cutter diameter, different profilings are obtained on the sloping surfaces of the cover plate 3. The shank-type cutter 8 and its mode of operation are indicated in FIG. 7.

Figure 13:
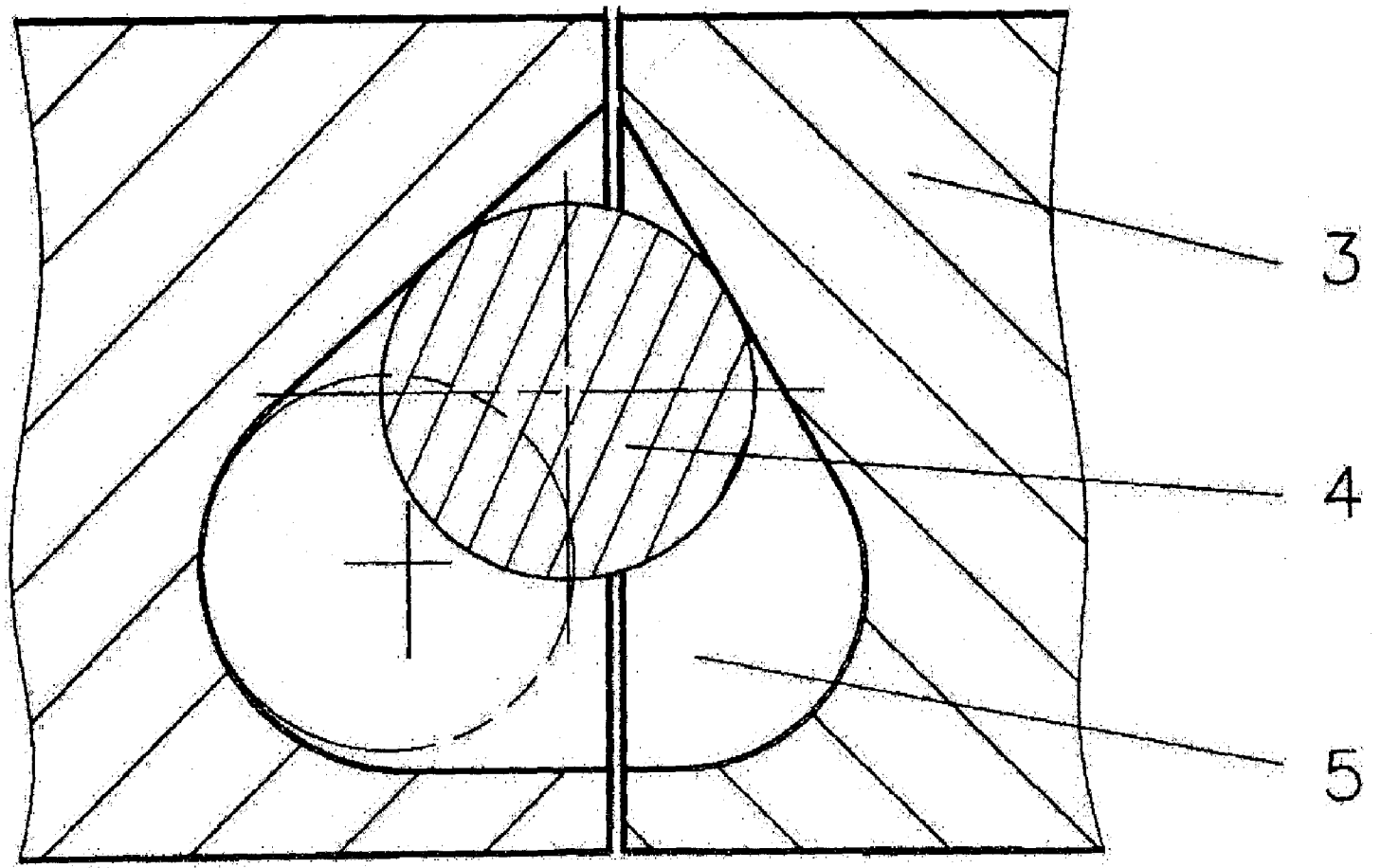
FIG. 13 is a sectional view showing different wedge angles in the two adjacent pockets.

The pockets 5 of two adjacent cover plates 3 are of a mirror-symmetrical design in the case shown and form together an essentially closed cavity. However, the function of the present invention is also preserved when the two adjacent pockets 5 form an asymmetric cavity contrary to the view shown. The asymmetry may be due to tolerances in the height and depth of the pockets 5 during their manufacture. However, it is also possible to select different wedge angles in the two adjacent pockets 5. To install the last rotor blade (end blade) in a stage, it may be necessary for the two pockets to be made open toward the blade profile side at that blade in order to avoid a collision with the two inserted pins 4 of the adjacent blades. This also results in an asymmetric cavity as shown in FIG. 13.

Figure 11:
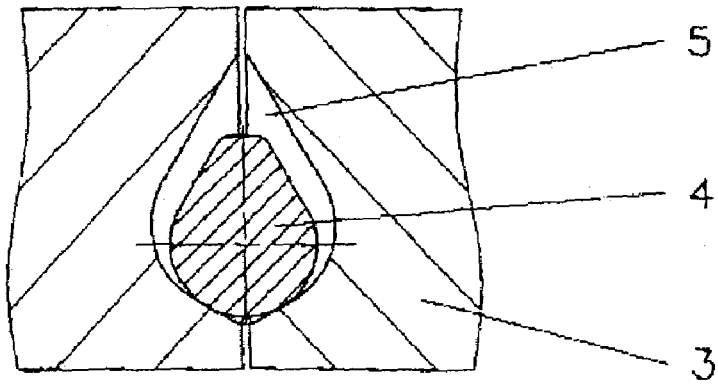
FIG. 11 is an example of a profiled pin.

The cavity formed by the pockets 5 narrows in the radial direction of the rotor base 6 in a wedge-shaped pattern. As can be recognized from FIGS. 11 and 12, the cavity has a drop-shaped design, and the cross section of the cavity at first expands to a largest cross section to subsequently converge again in a wedge-shaped pattern.

A pin 4, whose largest cross section is smaller than the largest cross section of the cavity but larger than its smallest cross section, is inserted freely movably into the cavity formed by the pockets 5. The pin 4 is beveled at both ends in order to avoid an unintended jamming in the cavity in the longitudinal direction. The shape of the pin may be cylindrical (FIG. 12) or profiled (FIG. 11) and adapted to the shape of the pockets 5.

Figure 8:
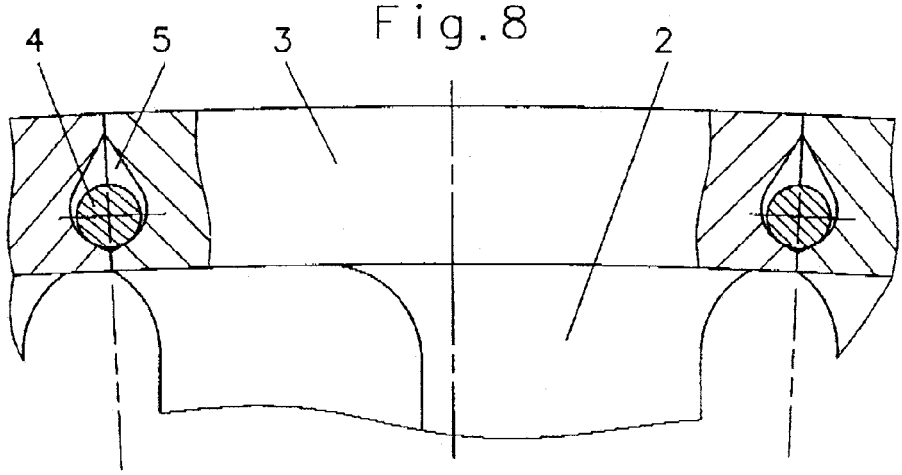
FIG. 8 is a detail X according to FIG. 5 on a larger scale during stoppage of the turbine.

FIGS. 8 and 9 show the function of the present invention. With the machine stopped (FIG. 8), the position of the pins 4 in the cavity is determined by the force of gravity, so that the pin 4 lies on the bottom of the cavity. In the operating state (FIG. 9), all pins 4 in the cavity are pressed to the outside by the centrifugal force acting on the pins 4. The gap A present between the cover plates 3 of two adjacent rotor blades is bridged over by the pin 4, and the vibrations on the rotor blade are damped by the contact or friction surfaces between the cover plate 3 and the pin 4.

Figure 10:
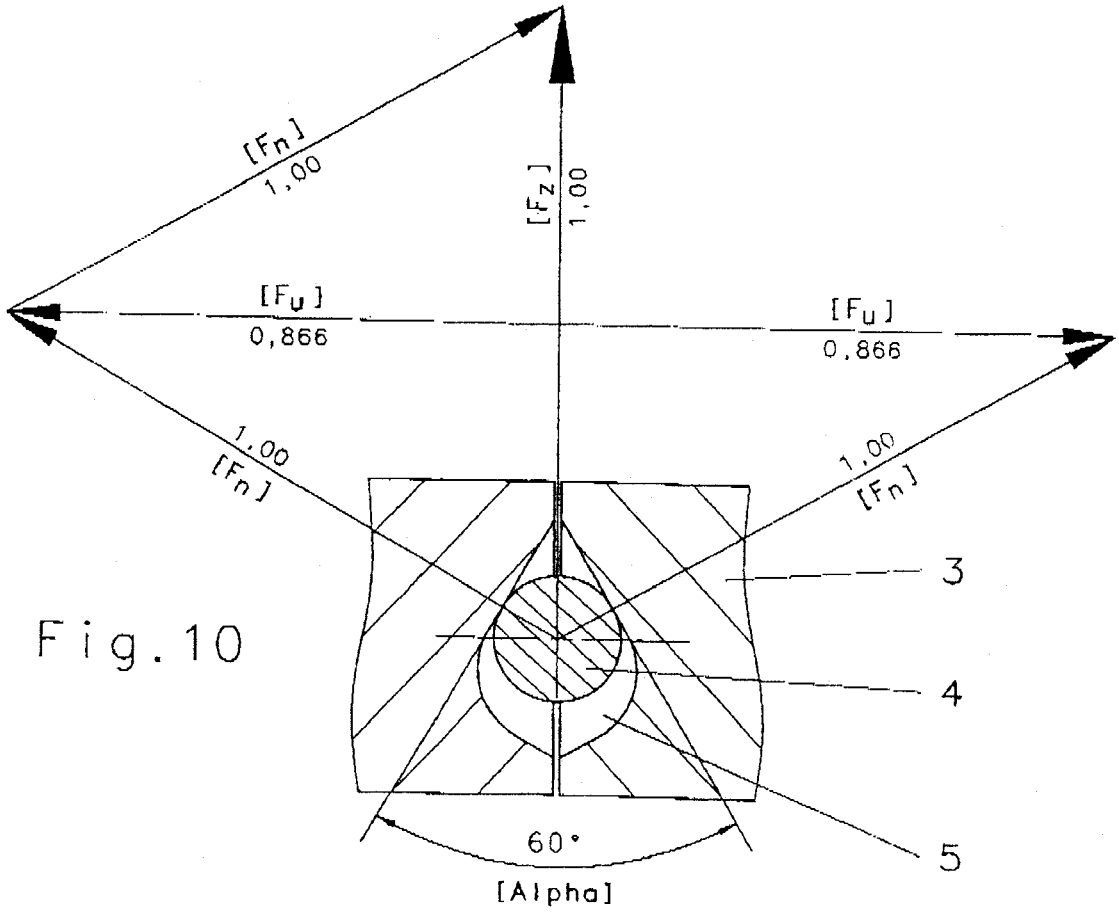
FIG. 10 is a view showing force triangles relative to the centrifugal force of the pin.

FIG. 10 shows the distribution of forces due to the centrifugal force ($F_z$) as a function of the wedge angle alpha. A smaller wedge angle leads to an increase in the normal force ($F_n$) and the circumferential force ($F_u$).

Figure 12:
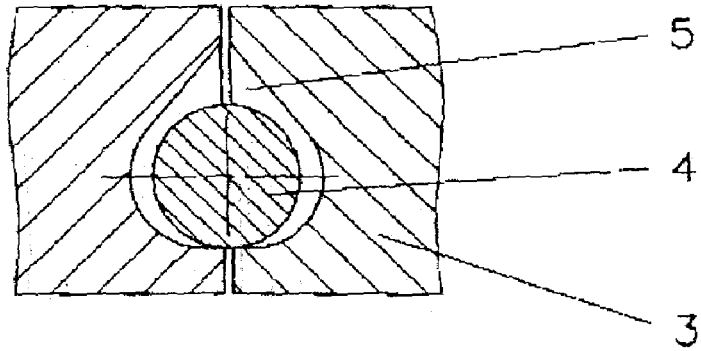
FIG. 12 is a special example of a recess of minimized height for very small cover plate heights.

The height of the cavity is determined by the wedge angle formed by the pockets 5 with one another. FIG. 12 shows the pockets 5, in which the two wedge surfaces are arranged at an angle smaller than 90° in relation to one another. The height of the pocket is minimized as a result. This embodiment may be used in case of small cover plate heights.

While specific embodiments of the invention have been shown and described in detail to illustrate the application of the principles of the invention, it will be understood that the invention may be embodied otherwise without departing from such principles.

What is claimed is:

1. A rotor of a steam or gas turbine, the rotor comprising:

rotor blades held in a rotor base in a plurality of radial rows, each rotor blade comprising a blade foot installed in the rotor base, a blade leaf and a cover plate, an open pocket being milled in the sloping surfaces of each of the cover plates of one row of said rotor blades, said sloping surfaces being located opposite each other with the pockets of two adjacent cover plates together forming an essentially closed cavity, which cavity expands in the radial direction of the rotor in a drop-like manner to a largest cross section and narrows from said largest cross section and which cavity ends in two planar wedge surfaces;

a plurality of pins, each of said pins having a largest cross section that is smaller than a largest cross section of the cavity and larger than the smallest cross section of the cavity, each of said pins being placed freely movably in a corresponding said cavity.

2. A rotor in accordance with claim 1, wherein the pockets of two adjacent cover plates are mirror-symmetrical in relation to one another.

3. A rotor in accordance with claim 1, wherein the pockets of two adjacent cover plates are asymmetrical in relation to one another.

4. A rotor in accordance with claim 1, wherein the shape of each pin is adapted to the shape of the cavity.

5. A rotor in accordance with claim 1, wherein each pin is cylindrical.

6. A rotor in accordance with claim 1, wherein a wedge angle formed by the inner surfaces of the pockets of the cavity with respect to one another is greater than the angle at which self-locking of each pin in the cavity takes place.

7. A rotor of a steam or gas turbine, the rotor comprising:

a rotor base;

a plurality of rotor blades held in said rotor base in a plurality of radial rows, each rotor blade comprising a blade foot installed in the rotor base, a blade leaf and a solid metal cover plate with side sloping surfaces, an open pocket being milled into the solid metal side sloping surfaces of each of said cover plates of one row of said rotor blades, said sloping surfaces being located opposite each other with the pockets each having a planar wedge surface followed by a curved surface and pockets of two adjacent cover plates together forming an essentially closed cavity to provide a plurality of cavities, each of said planar wedge surfaces being angled away from each other and being followed by said curved surface with said wedge surfaces and curved surfaces providing an expansion of said cavities in a radial direction of the rotor;

a plurality of pins, each of said pins being disposed freely movably in a corresponding one of said cavities, each of said pins having a largest cross section that is smaller than a largest cross section of said cavities and larger than a smallest cross section of said cavities.

8. A rotor in accordance with claim 7, wherein each of said cavities expands in a rotor radial direction to a largest cross section and narrows.

9. A rotor in accordance with claim 7, wherein each of said cavities is formed from two said pockets to have a drop-shaped design.

10. A rotor in accordance with claim 7, wherein the pockets of two adjacent cover plates are mirror-symmetrical in relation to one another.

11. A rotor in accordance with claim 7, wherein the pockets of two adjacent cover plates are asymmetrical in relation to one another.

12. A rotor in accordance with claim 7, wherein each of said pins has a shape adapted to the corresponding cavity.

13. A rotor in accordance with claim 7, wherein each pin is cylindrical.

14. A rotor in accordance with claim 7, wherein a wedge angle formed by the inner surfaces of the pockets of each of the cavities with respect to one another is greater than the angle at which self-locking of each pin in the cavity takes place.

15. A rotor of a steam or gas turbine, the rotor comprising:

a rotor base;

a plurality of rotor blades held in said rotor base in a plurality of radial rows, each rotor blade comprising a blade foot installed in the rotor base, a blade leaf and a cover plate, an open pocket being milled in the sloping surfaces of each of said cover plates of one row of said rotor blades, said sloping surfaces being located opposite each other with the pockets of two adjacent cover plates together forming an essentially closed cavity to provide a plurality of cavities, with respect to a direction of the rotor, each pocket having an arcuate wall extending from an axially inward portion of the respective sloping surface to expand the pocket radially and followed by a planar wedge surface extending axially from the arcuate surface to the respective axially outer portion of the respective sloping surface and toward the adjacent pocket;

a plurality of pins, each of said pins being disposed freely movably in a corresponding one of said cavities, each of said pins having a largest cross section that is smaller than a largest cross section of said cavities and larger than a smallest cross section of said cavities.

16. A rotor in accordance with claim 15, wherein an angle of at least one wedge surface of one of said plurality of rotor blades is different from an angle of at least one other wedge surface of an adjacent one of said plurality of rotor blades with said at least one wedge surface and said at least one other wedge surface form a single cavity.

* * * * *